US007326099B2

(12) United States Patent
Tobias

(10) Patent No.: US 7,326,099 B2
(45) **Date of Patent: *Feb. 5, 2008**

(54) TOY BUBBLE-IN-BUBBLE GENERATING ASSEMBLY

(76) Inventor: Tomas T. Tobias, 4 A Boyd Ct., Jersey City, NJ (US) 07304

( * ) Notice: Subject to any disclaimer, the term of this patent is extended or adjusted under 35 U.S.C. 154(b) by 261 days.

This patent is subject to a terminal disclaimer.

(21) Appl. No.: 11/214,291

(22) Filed: Aug. 29, 2005

(65) Prior Publication Data

US 2005/0287900 A1 Dec. 29, 2005

Related U.S. Application Data

(63) Continuation-in-part of application No. 10/261,239, filed on Sep. 30, 2002, now Pat. No. 6,948,996.

(51) Int. Cl.
*A63H 33/28* (2006.01)

(52) U.S. Cl. ..... 446/15; 446/19

(58) Field of Classification Search ..... 446/15, 446/16, 17, 18, 19, 20, 21, 74, 267
See application file for complete search history.

(56) References Cited

U.S. PATENT DOCUMENTS 654,642 A 7/1900 James
2,041,423 A 5/1936 Mausolf
2,213,391 A 9/1940 Gamble
2,527,935 A 10/1950 Joel, II
3,093,925 A 6/1963 Greene
3,323,250 A * 6/1967 Gibbons ..... 446/15
3,402,502 A 9/1968 Kaysen
4,467,552 A 8/1984 Jernigan ..... 446/15
5,035,665 A * 7/1991 Sheng ..... 446/15
5,462,469 A 10/1995 Lei ..... 446/15
6,102,764 A 8/2000 Thai ..... 446/15
6,139,391 A * 10/2000 Thai et al. ..... 446/15
6,948,996 B2 * 9/2005 Tobias, Jr. ..... 446/15

* cited by examiner

*Primary Examiner*—John A. Ricci
(74) *Attorney, Agent, or Firm*—Irwin Ostroff

(57) ABSTRACT

A toy bubble-in-bubble assembly includes first and second coupled together bubble generators and first and second air supply conduits. The first gas supply conduit is positioned relative to the first bubble generator such that gas passing through the first air supply conduit impinges on the first bubble generator. The second gas supply conduit is positioned relative to the second bubble generator such that gas passing through the second gas supply conduit impinges on the second bubble generator. The openings in the first and second bubble generators are adjacent and positioned relative to each other such that a bubble generated at the opening in the first bubble generator is adjacent to an opening in the second bubble generator and thus enables the generated bubble to be blown into an opening in the second bubble generator to generate a bubble within a bubble.

12 Claims, 6 Drawing Sheets

TOY BUBBLE-IN-BUBBLE GENERATING ASSEMBLY

CROSS-REFERENCE TO RELATED APPLICATIONS

This application is a Continuation-In-Part of U.S. application Ser. No. 10/261,239, filed Sep. 30, 2002 now U.S. Pat. No. 6,948,996.

FIELD OF THE INVENTION

The present invention relates to bubble generating apparatus, and more particularly, to toy bubble(s)-in-bubble generating assemblies.

BACKGROUND OF THE INVENTION

A variety of bubble generating toys exists with the simplest perhaps being a stick having a circular member mounted on the top. The circular member is dipped into a bubble solution or bubble producing liquid (e.g., soap) and then removed with a circular opening thereof then being covered with a film of the bubble solution. Blowing air against the film or waving the stick results in the formation of an individual bubble and perhaps several other individual bubbles.

U.S. Pat. No. 2,527,935 (Joel, II) describes a device which is used to generate a bubble within a bubble and includes a handle connected to a parallel combination of two rings with one ring having a smaller diameter than the other. The handle is connected to the larger ring which is connected via a supporting arm to the smaller ring. The two rings are placed in a bubble solution to form films across each. With the smaller ring placed in front of a persons mouth, air is blown across the smaller and larger rings to generate a bubble with a bubble. This device can relatively easily malfunction, and even when generating a bubble within a bubble, the two bubbles can stick together. Although not completely understood, it is thought that the reason this bubble generator does not repeatedly generate the desired bubble within a bubble is that when a person puckers his(her) lips to generate a stream of air which will result in a bubble, most of the air hits the small ring and generates a small bubble and there is not enough air to both blow the small bubble into the second ring and/or to generate a larger bubble from the second ring.

U.S. Pat. No. 4,467,552 (Jernigan) describes a bubble blowing toy having two blowing loops connected by a common support member with the loops being disposed in perpendicular planes. The loops produce different types of bubbles. While one loop is being used to produce bubbles, the opposite end loop serves as a handle. One loop is used to generate a bubble within a bubble and the other loop is used to generate two bubbles that share a common side wall. This device can relatively easily malfunction, and even when generating a bubble within a bubble, the two bubbles can stick together.

U.S. Pat. No. 654,642 (James) and U.S. Pat. No. 2,213,391 (Gamble) are examples of bubble generating toys which generate at least one bubble within a bubble. Both use a hollow pipe connected to a circular member which has at least two passages formed there through. Blowing into each of the respective the pipes generates a bubble within a bubble. U.S. Pat. No. 3,402,502 is another example of a bubble generating toy which generates a bubble within a bubble. It uses a fairly complex structure having inner and outer shells and valve. With the value in a first position one blows into a mouthpiece to generate a first bubble. The position of the valve is then changed and then one blows into the mouthpiece to generate a second bubble with surrounds the first bubble. This is a fairly complex device which is relatively expensive to implement.

U.S. Pat. No. 2,041,423 (Mausolf) also uses a hollow pipe connected to a circular member which has three to five passages formed there through to generate three or more bubbles which each share a portion of a common side wall. It does not generate a bubble within a bubble.

U.S. Pat. No. 6,102,764 (Thai) describes a bubble producing assembly which includes a handle, an electrically powered variable speed fan, a primary loop, and a plurality of secondary loops. This assembly is capable of producing a bubble within a bubble or multiple bubbles with a bubble. It is relatively complex and expensive to produce. The turning on of the assembly and subsequent control of the speed of the motor is all that is needed to produce bubbles. Essentially no eye, hand, mouth coordination is required. This limits the amusement value and learning potential for children.

It is desirable to have a bubble generator which generates a bubble within a bubble, is relatively inexpensive to produce, provides a user with amusement, can improve hand and mouth coordination, and is more reliable than the bubble-in-bubble generator described in U.S. Pat. No. 2,527,935.

SUMMARY OF THE INVENTION

From a first apparatus aspect, the present invention is directed to a Bubble-In-Bubble generating assembly comprising first and second bubble generators and first and second gas supply conduits. The first bubble generator defines an opening therein that limits the size of a bubble generated by the first bubble generator. The first gas supply conduit is positioned relative to the first bubble generator such that gas passing through the first air supply conduit impinges on the first bubble generator. The second bubble generator defines an opening therein that limits the size of a bubble generated by the second bubble generator. The second gas supply conduit is positioned relative to the second bubble generator such that gas passing through the second gas supply conduit impinges on the second bubble generator. The opening in the first bubble generator is smaller than the opening in the second bubble generator. The first and second bubble generators are coupled together. The openings in the first and second bubble generators are adjacent to and positioned relative to each other such that a bubble generated at the opening in the first bubble generator is adjacent to the opening in the second bubble generator and thus enables the generated bubble to be blown into the opening in the second bubble generator to generate a bubble within a bubble.

From a second apparatus aspect, the present invention is a directed to a human breath powered Bubble-In-Bubble generating assembly comprising first and second bubble generators and first and second air supply conduits. The first bubble generator defines an opening therein that limits the size of a bubble generated by the first bubble generator. The first air supply conduit has first and second ends and is positioned relative to the opening in the first bubble generator such that with the first end inserted into the mouth of a person, air exhaled by the person enters the first end of the first air supply conduit, passes through the first air supply conduit, exits at the second end, and then impinges on the opening in the first bubble generator. The second bubble generator defines an opening therein that limits the size of a bubble generated by the second bubble generator. The second air supply conduit has first and second ends and is positioned relative to the opening in the second bubble generator such that with the first end of the second air supply conduit inserted into the mouth of a person, air exhaled by a person enters the first end, passes through the second air supply conduit, exits at the second end, and then impinges on the opening in the second bubble generator. The opening in the first bubble generator is smaller than the opening in the second bubble generator. The first and second bubble generators are coupled together. The openings in the first and second bubble generators are adjacent to and positioned relative to each other such that a bubble generated at the opening in the first bubble generator is adjacent to the opening in the second bubble generator and thus enables the generated bubble to be blown into the opening in the second bubble generator to generate a bubble within a bubble.

From a third apparatus aspect, the present invention is directed to a human breath powered Bubble-In-Bubble generating assembly comprising an animal shaped bubble generator, a ring bubble generator, and first and second air supply conduits. The animal shaped bubble generator defines an entrance opening and a exit opening and has side walls which define a cavity that is adapted to hold bubble solution and is in communication with the entrance and exit openings. The first air supply conduit has first and second ends and is positioned relative to the entrance opening in the animal shaped bubble generator such that with the first end of the first air supply conduit inserted into the mouth of a person, air exhaled from the mouth of the person enters the first end, passes through the first air supply conduit, exits at the second end, and then enters the entrance opening in the animal shaped bubble generator. The ring bubble generator defines an opening there through and is adapted to hold bubble solution. The second air supply conduit has first and second ends and is positioned relative to the opening in the ring bubble generator such that with the first end of the second air supply conduit inserted into the mouth of a person, air exhaled from the mouth of the person enters the first end and passes through the second air supply conduit, exits at the second end, and impinges on the opening in the ring bubble generator. The first ends of the first and second air conduits are appropriately sized to fit into the mouth a person and are positioned relative to each other such that both can be simultaneously inserted into the mouth of a person. The exit opening in the animal shaped bubble generator is smaller than the opening in the ring bubble generator. The animal shaped bubble generator and the ring bubble generator are coupled together. The exit opening in the animal shaped bubble generator and the opening in the ring bubble generator are adjacent to and positioned relative to each other such that a bubble generated at the exit opening in the animal shaped bubble generator is adjacent to the opening in the ring bubble generator and thus enables the generated bubble from the animal shaped bubble generator to be blown into the opening in the ring bubble generator to generate a bubble within a bubble.

The invention will be better understood from the following more detailed description taken in conjunction with the accompanying drawing and claims.

DETAILED DESCRIPTION

Figure 1:
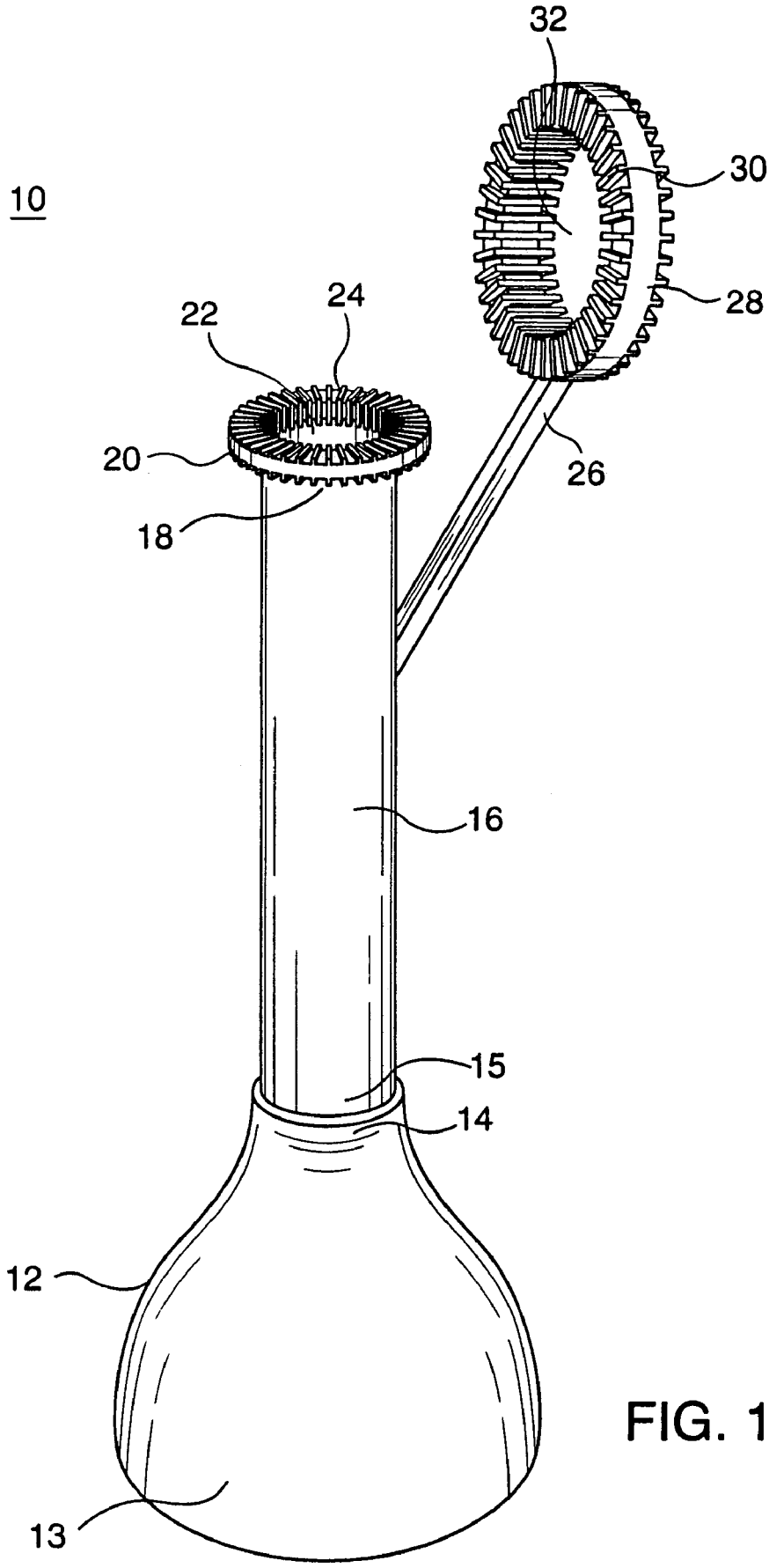
FIG. 1 shows a perspective view of a bubble-in-bubble generator assembly in accordance with one embodiment of the present invention.

Referring now to FIG. 1, there is shown a Bubble-In-Bubble Generating Assembly 10 in accordance with the present invention. Assembly 10 comprises a flexible member (bulb) 12 having walls which define a cavity 13 and a top portion 14, a conduit (tubular stick, hollow tube) 16, a first ring member (secondary loop member, first serrated ring, bubble generating member) 20 having optional ridges 24 and defining an opening (cavity) 22, a coupling (connecting) member 26, and a primary loop member (ring) 28 having optional ridges 30 and defining an opening 32.

A first end 15 of conduit 16 is connected to the top portion 14 of flexible member 12. Ring 20 is connected to a second end 18 of conduit 16 such that an open path exits from ring 20 through opening 22 and hollow conduit 16 to the cavity 13 defined by flexible member 12. Accordingly, air in cavity 13 is expelled through conduit 16 and opening 22 when flexible member 12 is squeezed (compressed).

The squeezing (compressing) of flexible member 12 generates to a first stream of gas (e.g., air) which passes through the opening 22. The coupling member 26 couples (connects) tube 16 to the ring 28 such that a front face of the ring 20 is essentially perpendicular to a front face of the ring 28. The ridges 24 on ring 20 and the ridges 30 on ring 28 are designed to help hold a film of a bubble solution covering each of the rings 20 and 28.

In order to generate a bubble within a bubble, rings 20 and 28 each have a separate film of bubble solution placed across each of the openings 20 and 32. This is easily accomplished by placing rings 20 and 28 in a container of bubble solution (not shown). The flexible member (bulb) 12 is then squeezed to generate a first stream of gas (air) from cavity 13 through hollow conduit 16 and opening 22 in ring 20. This first stream of air impinges on the film of bubble solution (not shown) covering opening 22 and causes a first bubble (not shown) to be generated above opening 22. In a preferred embodiment a person (not shown) then blows a second stream of air which causes the first bubble to be blown towards the opening 32 in ring 30 such that the first bubble and second stream of air impinge on the bubble solution film (not shown) covering the opening 32. This generates a second bubble with the first bubble being contained therein. Accordingly, a bubble-in-bubble is generated by assembly 10.

The first ring member 20 is optional and the top end 18 of the conduit 16 could serve as a first ring member and same would not necessarily need to have ridges but could have bumps, ridges, or ridges and bumps. In one illustrative embodiment the entire assemble 10 is fabricated from plastic. A variety of different materials, including but not limited to metal, wood, rubber, or man made materials could be used to form different parts of assembly 10.

Figure 2:
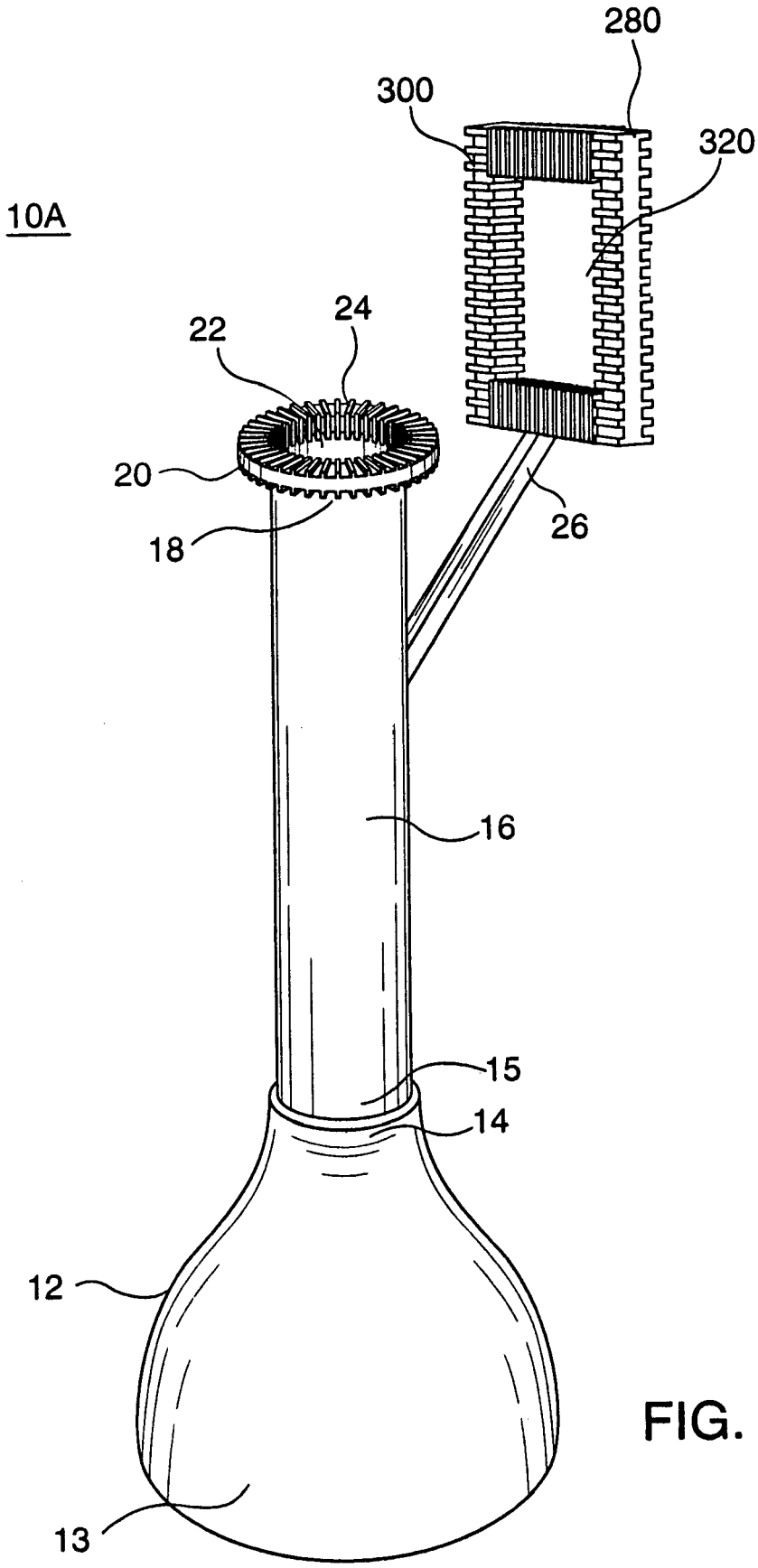
FIG. 2 shows a perspective view of a bubble-in-bubble generator assembly in accordance with an other embodiment of the present invention.

Referring now to FIG. 2, there is shown a Bubble-In-Bubble Generating Assembly 10A in accordance with an other embodiment of the present invention. Assembly 10A is very similar to assembly 10 of FIG. 1 with essentially identical parts of the two shown having the same reference numbers and parts which perform the same function having the same reference number with a "0" thereafter. Assembly 10A has a second ring (primary loop member) 280 that has a rectangular shape and defines a rectangular opening 320 and has optional ridges 300. It also generates a bubble-in-bubble using the same gas (air) flows as assembly 10 of FIG. 1.

Figure 3:
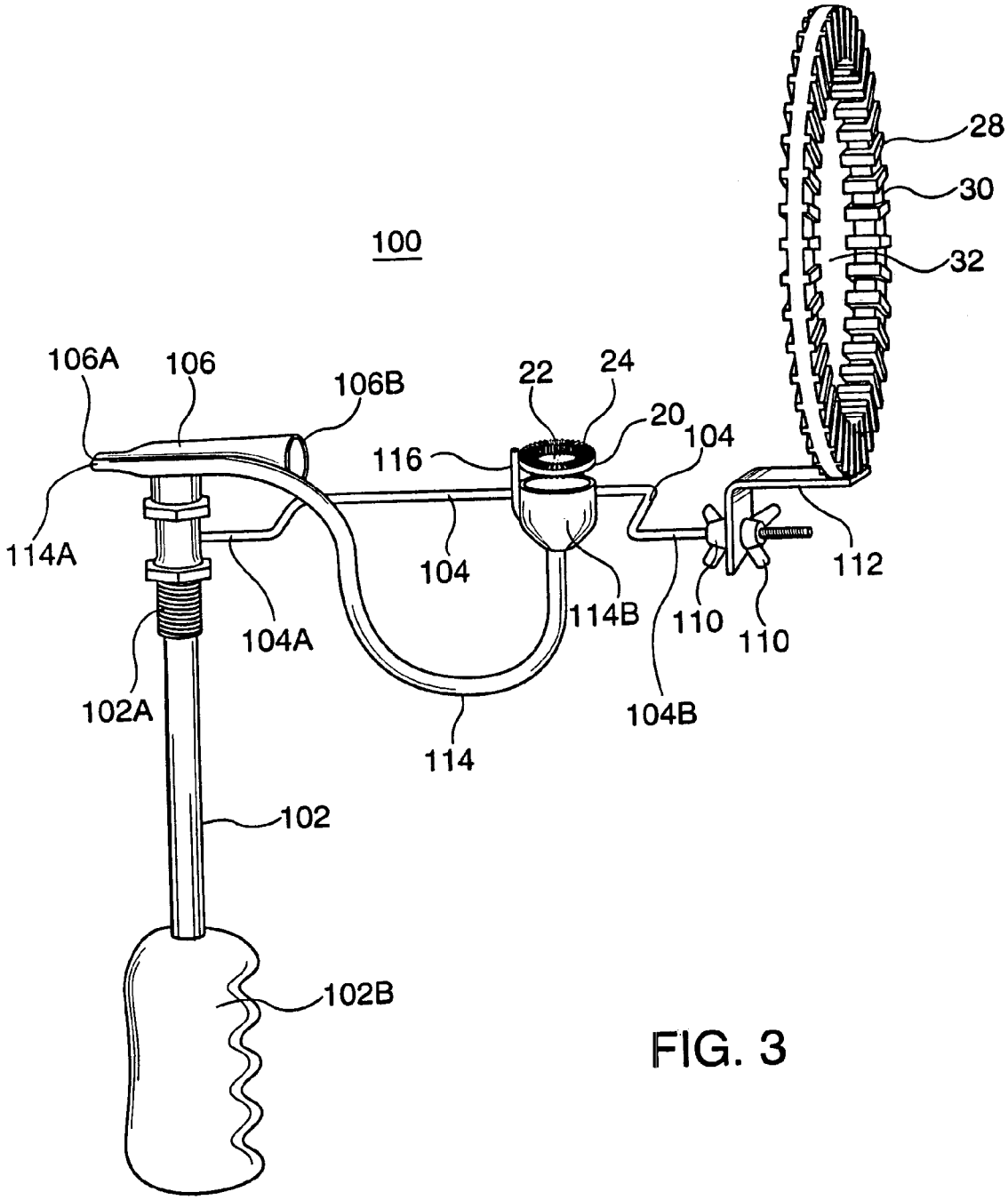
FIG. 3 shows a perspective view of a bubble-in-bubble generator assembly in accordance with still an other embodiment of the present invention.

Referring now to FIG. 3, there is shown a Bubble-In-Bubble Generating Assembly 100 in accordance with an embodiment of the present invention. Assembly 100 comprises a handle 102 having a first end 102A and a second end 102B, a first ring 20 having optional ridges 24 and defining an opening 22 there through, a first connecting member 104 having a first end 104A and a second end 104B, a second ring 28 having optional ridges 30 and defining an opening 32 there through, a first hollow conduit 106 having a first end 106A and a second end 106B, a connector 110 (a pair of wingnuts), and a second hollow conduit 114 having a first end 114A and a second end 114B which is fluted, a second connecting member 116, and a third connecting member 112.

First ends 106A and 114A of conduits 106 and 114, respectively, are positioned on the first end 102A of handle 102 and are optionally touching each other. Ends 106A and 114A can optionally be formed together as a single conduit which forms one arm of a y-shaped member. The fluted second end 114B of conduit 114 is connected through second connecting member 116 to one surface of the ring 20. Connecting member 116 separates second end 114B from ring 20. The second end 106B of the conduit 106 is located adjacent to a second (opposite) surface of ring 20 such that with a gas steam introduced into ends 106A and 114A there are generated streams of gas at ends 106B and 114B which are essentially perpendicular to each other.

Connecting member 104 has a connecting first end portion 104A which is adjustably connected to handle 102 and has a second end 104B which is connected to connector 110 (shown as two wingnuts engaging a threaded portion of connecting member 104. Ring 28 is connected to the connecting member 112 which is connected to the connecting member 104 via connector (wingnuts) 110. The horizontal distance between the opening 24 in ring 20 and the opening 32 in ring 28 can be adjusted by varying the length of the portion of the connecting member 104 between the handle 102 and the connector 110. The vertical position of opening 32 in ring 28 relative to the opening 24 in ring 20 can be varied by moving the second end 104A of connector 104 up or down handle 102. Planes across the opening 24 in ring 20 and the opening 32 in ring 28 are typically essentially perpendicular to each other. Optionally they need not be perpendicular but are not parallel to each other. With films of bubble solution (not shown) across openings 24 and 32 and flows of gas (e.g., air blow from the mouth of a person, or a pump, or a source of compressed gas such as air), a first bubble (not shown) is generated above the opening 24 in ring 20. The first bubble is then blown by the stream of gas exiting conduit 106 at end 106B into the film of bubble solution covering opening 32 in ring 28. This causes a second bubble (not shown) to be generated from the film across the opening 32 with the first bubble being contained therein.

Figure 4:
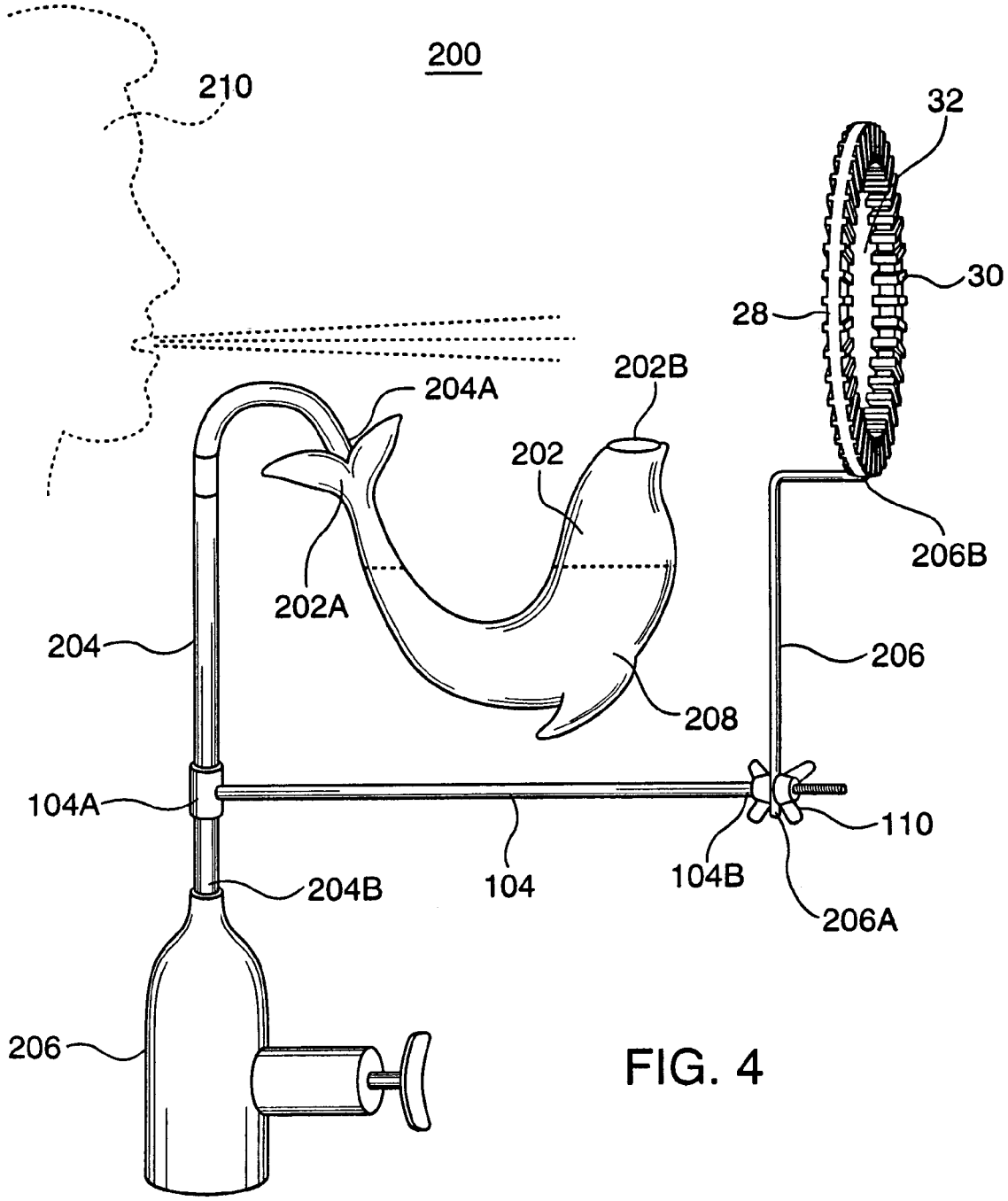
FIG. 4 shows a perspective view of a bubble-in-bubble generator assembly in accordance with still an other embodiment of the present invention.

Referring now to FIG. 4, there is shown a Bubble-In-Bubble Generating Assembly 200 in accordance with an other embodiment of the present invention. Assembly 200 comprises a hollow conduit 204 having a first end 204A and a second end 204B, a source of gas 206 (e.g., a hand held pump), a three dimensional animal figure 202 (e.g., a fish) having an input port 204A and an output (opening) 202B, and having side walls which define a cavity there between which is shown containing a bubble solution 208, a ring 28 having optional ridges 30 and defining an opening 32 there through, a first connecting member 104 having a first end 104A and a second end 104B, a second connecting member 206, and a slideable connector 110.

End 204B of the hollow conduit 204 is connected to an output port of the gas source 206 which is optionally shown as a hand held pump but could be any other gas source such as a container of compressed air or a bulb. Connecting member 104 has a connecting first end portion 104A which is slideable connectable to the conduit 204 and has a second end 104B which is connected to the slideable connector 110. The second connecting member 206 has one end 206A connected to connector 110 and has a second end 206B connected to ring 28. The horizontal distance between the output port (opening) 202B and ring 28 can be adjusted by varying the length of the connecting member 104 between the conduit 204 and the connector 110. The vertical position of ring 28 relative to the output opening 202*b* of animal figure 202 can be varied by moving second end 104A of connector 104 up or down conduit 204. Planes across the opening 202B of animal figure 202 and the opening 32 of ring 28 are typically essentially perpendicular to each other. Optionally they need not be perpendicular but are not parallel to each other.

With the cavity in animal figure 202 at least partly filled with bubble solution 208 and a film of bubble solution (not shown) across opening 32 of ring 28, and flows of gas (e.g., air blow from the mouth of a person 210 and the hand held pump 206), a first bubble (not shown) is generated above the opening 202B in animal figure 202. The first bubble is then blown by the stream of air from a persons mouth into the film of bubble solution covering opening 32 in ring 28. This causes a second bubble (not shown) to be generated from the film across the opening 32 with the first bubble being contained therein.

Figure 5:
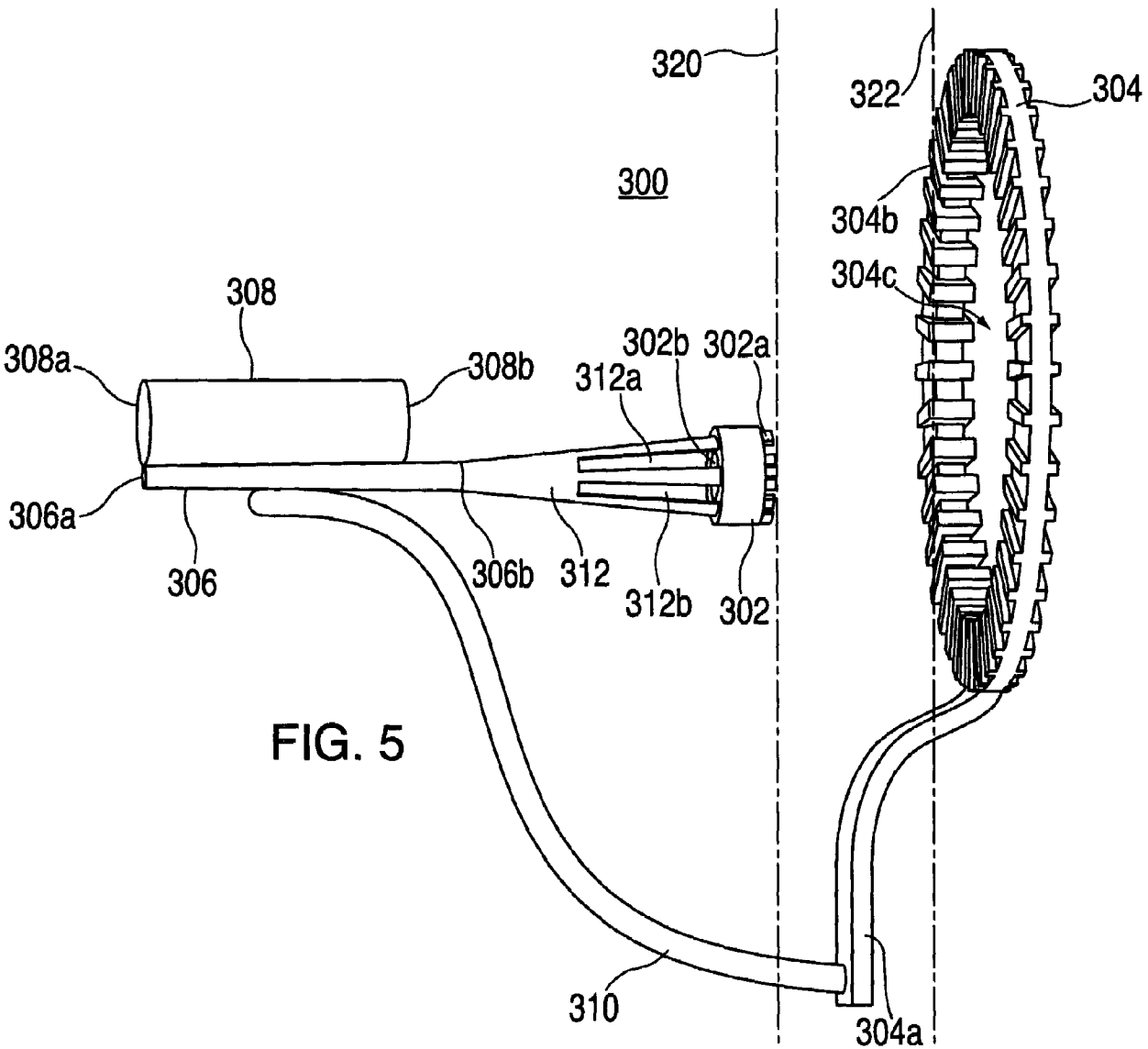
FIG. 5 shows a perspective view of a bubble-in-bubble generator assembly in accordance with still an other embodiment of the present invention.

Referring now to FIG. 5, there is shown a human breath powered Bubble-In-Bubble Generating Assembly 300 in accordance with an other embodiment of the present invention. Assembly 300 comprises a first bubble generator (ring) 302, a second bubble generator (ring) 304, a first gas (air) conduit 306, a second gas (air) conduit 308, a first connector member 310, and a second connector member 312. The ring 304 has optional ridges 304*b* and defines an opening 304*c* there through. The ring 302 has optional ridges 302*a* and defines an opening 302*c* there through. Opening 302*a* is smaller than opening 304*c*. The ridges 302*a* and 304*b* are designed to hold bubble solution. Planes 320 and 322 across the opening 302*c* of ring 302 and the opening 304*c* of ring 304, respectively, are shown as essentially parallel to each other. These planes can be perpendicular, as are the opening 22 and 32 of rings 20 and 30, respectively, of bubble-in-bubble generating assembly 100 of FIG. 3, or they can form an acute angle.

Conduit 306 has a first end 306*a* and a second end 306*b*. Conduit 308 has a first end 308*a* and a second end 308*b*. The second end 306*b* of conduit 306 is coupled to a first end of second connector member 312. A second end of connector member 312 is coupled (connected) to the ring 302. The second end of connector member 310 is coupled (connected) to a handle portion 304*a* of the ring 304. In a preferred embodiment first ends 306*a* and 308*a* of gas conduits 306 and 308, respectively, are essentially in a common plane and next to each other so as to facilitate insertion of both into the mouth of a person who wishes to generate, using human breath to power assembly 300, a bubble in a bubble. In addition, conduits 306 and 308 are typically coupled (connected) together, and the opening at the end 308*a* of conduit 308 is larger than the opening at the end 306*a* of conduit 306. Connector member 312 has openings 312*a* and 312*b* as well as a third opening which can not be seen in FIG. 5. These openings 312*a*, 312*b*, and the third opening are preferred, however, they are not necessary, and conduit 306 could extend directly to and couple (connect) with ring 302. Connector 310 couples (connects) conduits 306 and 308 to ring 304. Connector 310 can optionally be coupled (connected) to one of conduits 306 and 308 with that conduit being coupled (connected) to the other.

In typical operation, rings 302 and 304 are first dipped into a container (not shown) containing bubble solution (not shown). A person then places ends 306*a* and 308*a* into his or her mouth and then blows air into conduits 306 and 308. This generates a first bubble (not shown) that exits opening 302*a* of ring 302 and is then blown into a film of bubble solution (not shown) covering opening 304*a* of ring 304 where it and the stream of air from conduit 308 generate a second larger bubble from the film of bubble solution (not shown) covering opening 304*c* of ring 304. The bubble generated from ring 302 is formed within a larger bubble generated from ring 304. The net result is the generation of a bubble in a bubble.

Figure 6:
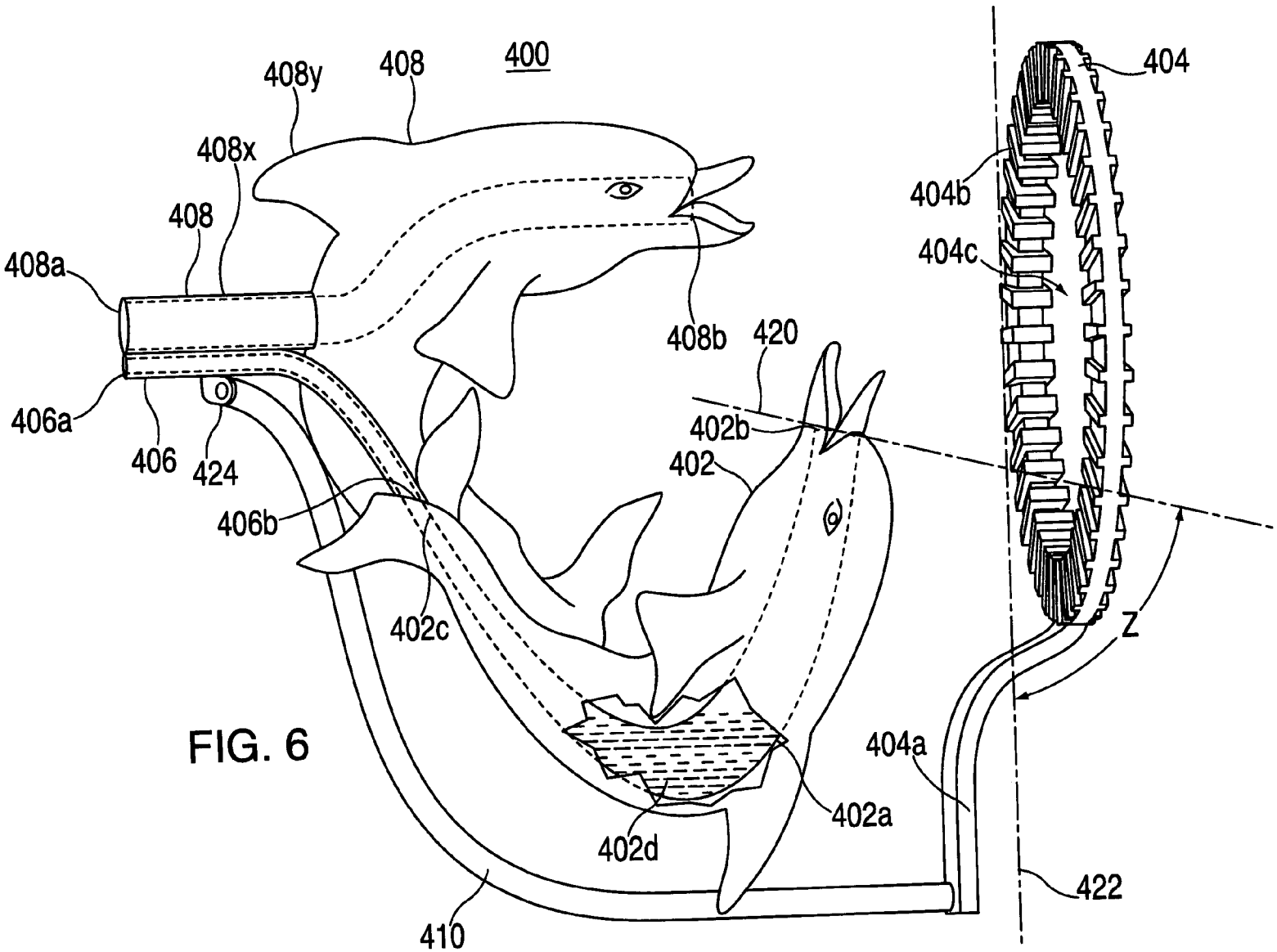
FIG. 6 shows a perspective view of a bubble-in-bubble generator assembly in accordance with still an other embodiment of the present invention.

Referring now to FIG. 6, there is shown a human breath powered Bubble-In-Bubble Generating Assembly 400 in accordance with an other embodiment of the present invention. Assembly 400 comprises a first bubble generator (shown as a fish) 402, a second bubble generator (ring) 404, a first gas (air) conduit 406, a second gas (air) conduit 408 shown as a fish with a first section 408*x* thereof being in the shape of a cylindrical member 408*x* and a second section 408*y* thereof in the shape of a fish, and a connector member 410. Conduit 408 could simply be only a cylindrical member. The ring 404 has an optional handle 404*a*, optional ridges 404*b*, and defines an opening 404*c* there through. The first bubble generator 402 defines an input opening 402*c*, and output opening 402*b*, and has wall portions which define a cavity 402*a* in which is shown bubble solution 402*d* via dashed lines. Opening 402*b* is smaller than opening 404*c*. The ridges 404*b* are designed to hold bubble solution. Planes, shown as dashed lines 420 and 422 across the opening 402*b* of the first bubble generator 402 and the opening 404*c* of second bubble generator 404, respectively, are extended to intersect at an acute angle z. Planes 420 and 422 can be parallel to each other or can be perpendicular to each other.

Conduit 406 has a first end 406*a* and a second end 406*b*. Conduit 408 has a first end 408*a* and a second end 408*b*. The second end 406*b* of conduit 406 is coupled to the input opening 402*c* of bubble generator 402. A first end of connector member 410 is coupled to conduit 406 via a hinge 424 to allow the second bubble generator 404 to be rotated so as to more easily allow it to be dipped in a bubble solution without having any go into bubble generator 402. A second end of connector member 410 is coupled (connected) to an optional handle portion 404*a* of the ring 404. In a preferred embodiment, first ends 406*a* and 408*a* of gas conduits 406 and 408, respectively, are essentially in a common plane and next to each other so as to facilitate insertion of both into the mouth of a person who wishes to generate, using human breath, a bubble in a bubble. In addition, section 408*x* and conduit 408 are typically coupled (connected) together and the opening at the end 408*a* of conduit 408 is larger than the opening at the end 406*a* of conduit 406. Connector 410 couples (connects) conduits 406 and 408 to ring 404. Connector 410 can optionally be coupled (connected) to one of conduits 406 and 408 with that conduit being coupled (connected) to the other.

In typical operation, cavity 402*a* of first bubble generator 404 is partly filled with bubble solution 402*d* and ring 404 is dipped into a container (not shown) containing bubble solution (not shown) to form a bubble film (not shown) across opening 404*c*. A person then places ends 406*a* and 408*a* into his or her mouth and blows air into conduits 406 and 408, This generates a first bubble (not shown) which exits opening 402*b* of bubble generator 402 and is then blown into the film of bubble solution (not shown) covering opening 404*a* of ring 404 where it and the stream of air from conduit 408 generate a second larger bubble from the film of bubble solution (not shown) covering opening 404*c* of ring 404. The bubble generated from bubble generator 402 is formed within a larger bubble generated from ring 404. The net result is the generation of a bubble in a bubble.

It is to be understood that the specific embodiments described are merely illustrative of the general principles of the invention and that, accordingly, other embodiments may be devised by a skilled worker in the art without departing from the spirit and scope of the invention. For example, the shape of each of the rings 20 (secondary loop member) and 28 (primary loop member) can be other than circular such square, rectangular, triangular, or other geometric shapes so long as the opening in the secondary loop member (ring) is smaller than in the primary loop member (ring). Still further, a second flexible member and conduit coupled together, as are flexible member 12 and conduit 16 of FIGS. 1 and 2, can be connected via an other coupling (connecting) member to the top of conduit 16 such that as a first bubble is generated by squeezing flexible member 12, the second flexible member is squeezed so as to blow the first bubble into the bubble solution film across opening 32 so as to generate a second bubble with the first bubble contained therein. Still further, the conduits 16 of FIGS. 1 and 2 can have fluted ends, such as fluted end 114B as conduit 114 of FIG. 3, and each can have a connecting member 116 which connects and separates rings 20 from conduit 16. Furthermore, the animal figure 202 of FIG. 4 can be substituted for the fluted end 114B of conduit 114, the connecting member 116, and the ring 20 of assembly 100 of FIG. 3. Still furthermore, there can be a plurality of first bubble generators, like first bubble generators 302 of FIG. 5 or 402 of FIG. 6, such that multiple small bubbles can be generated with a larger bubble. These additional first bubble generators can have openings from which the bubbles are emitted that are in the same plane or another plane as the first bubble generator. For example, an addition ring 302 with a second air conduit 306 could be added to apparatus 300 of FIG. 5 with the second ring 302 being separated from the first ring 302 and defining an opening that is in the same plane as the plane of the opening 302*c*. This second ring 302 could also have an opening that is in a plane perpendicular to the plane of the opening in the first ring 302 or one that and forms an acute angle with the plane of the opening in the first ring 302. This second ring 302 could be located in a plane closer to the ring 304 than the first ring 302.

What is claimed is:

1. A Bubble-In-Bubble generating assembly comprising:

a first bubble generator defining an opening therein that limits the size of a bubble generated by the first bubble generator;

a first gas supply conduit being positioned relative to the first bubble generator such that gas passing through the first air supply conduit impinges on the first bubble generator;

a second bubble generator defining an opening therein that limits the size of a bubble generated by the second bubble generator;

a second gas supply conduit being positioned relative to the second bubble generator such that gas passing through the second gas supply conduit impinges on the second bubble generator;

the opening in the first bubble generator being smaller than the opening in the second bubble generator;

the first and second supply conduits being separate members that do not share a common portion through which gas can flow;

the first and second bubble generators being coupled together; and the openings in the first and second bubble generators being adjacent and positioned relative to each other such that a bubble generated at the opening in the first bubble generator is adjacent to the opening in the second bubble generator and thus enables the generated bubble to be blown into the opening in the second bubble generator to generate a bubble within a bubble.

2. The Bubble-In-Bubble generating assembly of claim 1 wherein a plane across the opening in the first bubble generator being in a parallel relation to a plane across the opening in the second bubble generator.

3. The Bubble-In-Bubble generating assembly of claim 1 wherein a plane across the opening in the first bubble generator being in a non-parallel relation to a plane across the opening in the second bubble generator.

4. The Bubble-In-Bubble generating assembly of claim 1 wherein the cross-sectional area of the first gas supply conduit is smaller that the cross-sectional area of the second gas supply conduit.

5. The Bubble-In-Bubble generating assembly of claim 1 wherein the first and second gas supply conduits each have first and second ends with the respective first ends being coupled together, the second end of the first gas supply conduit being in communication with the opening in the first bubble generator, and the second end of the second gas supply conduit being in communication with the opening in the second bubble generator.

6. The Bubble-In-Bubble generating assembly of claim 1 wherein the first and second bubble generators are both in the shape of a ring.

7. The Bubble-In-Bubble generating assembly of claim 1 wherein the first bubble generator has the shape of a fish and the second bubble generator has the shape of a ring.

8. A human breath powered Bubble-In-Bubble generating assembly comprising:

a first bubble generator defining an opening therein that limits the size of a bubble generated by the first bubble generator;

a first air supply conduit having first and second ends and being positioned relative to the opening in the first bubble generator such that with the first end inserted into the mouth of a person, air exhaled by the person enters the first end of the first air supply conduit, passes through the first air supply conduit, exits at the second end, and then impinges on the opening in the first bubble generator;

a second bubble generator defining an opening therein that limits the size of a bubble generated by the second bubble generator;

a second air supply conduit having first and second ends and being positioned relative to the opening in the second bubble generator such that with the first end of the second air supply conduit inserted into the mouth of a person, air exhaled by a person enters the first end, passes through the second air supply conduit, exits at the second end, and then impinges on the opening in the second bubble generator;

the opening in the first bubble generator being smaller than the opening in the second bubble generator;

the first and second bubble generators being coupled together; and the openings in the first and second bubble generators being adjacent and positioned relative to each other such that a bubble generated at the opening in the first bubble generator is adjacent to the opening in the second bubble generator and thus enables the generated bubble to be blown into the opening in the second bubble generator to generate a bubble within a bubble.

9. A human breath powered Bubble-In-Bubble generating assembly comprising:

an animal shaped bubble generator defining an entrance opening and a exit opening and having side walls that define a cavity that is adapted to hold bubble solution and is in communication with the entrance and exit openings;

a first air supply conduit having first and second ends and being positioned relative to the entrance opening in the animal shaped bubble generator such that with the first end of the first air supply conduit inserted into the mouth of a person, air exhaled from the mouth of the person enters the first end, passes through the first air supply conduit, exits at the second end, and then enters the entrance opening in the animal shaped bubble generator;

a ring bubble generator defining an opening there through and being adapted to hold bubble solution;

a second air supply conduit having first and second ends and being positioned relative to the opening in the ring bubble generator such that with the first end of the second air supply conduit inserted into the mouth of a person, air exhaled from the mouth of the person enters the first end and passes through the second air supply conduit, exits at the second end, and impinges on the opening in the ring bubble generator;

the first ends of the first sand second air conduits being appropriately sized to fit into the mouth a person and being positioned relative to each other such that both can be simultaneously inserted into the mouth of a person;

the exit opening in the animal shaped bubble generator being smaller than the opening in the ring bubble generator;

the animal shaped bubble generator and the ring bubble generator being coupled together; and the exit opening in the animal shaped bubble generator and the opening in the ring bubble generator being adjacent and positioned relative to each other such that a bubble generated at the exit opening in the animal shaped bubble generator is adjacent to the opening in the ring bubble generator and thus enables the generated bubble from the animal shaped bubble generator to be blown into the opening in the ring bubble generator to generate a bubble within a bubble.

10. The human breath powered Bubble-In-Bubble generating assembly of claim 9 wherein the cross-sectional area of the first air supply conduit is smaller that the cross-sectional area of the second air supply conduit.

11. The human breath powered Bubble-In-Bubble generating assembly of claim 9 wherein the first air supply conduit is partly in the shape of a fish.

12. The human breath powered Bubble-In-Bubble generating assembly of claim 9 wherein both air conduits are coupled together at the first respective first ends thereof.

* * * * *